US007418768B2

(12) United States Patent
Henninger

(10) Patent No.: US 7,418,768 B2
(45) Date of Patent: Sep. 2, 2008

(54) SET, COMPRISING A PLURALITY OF NEEDLES HAVING AN ANGULAR FRONT TIP

(75) Inventor: Friedrich Henninger, Flachslanden (DE)

(73) Assignee: Staedtler & UHL KG, Schwabach (DE)

( * ) Notice: Subject to any disclaimer, the term of this patent is extended or adjusted under 35 U.S.C. 154(b) by 2 days.

(21) Appl. No.: 10/576,711

(22) PCT Filed: Oct. 18, 2004

(86) PCT No.: PCT/EP2004/011720

§ 371 (c)(1),
(2), (4) Date: Apr. 21, 2006

(87) PCT Pub. No.: WO2005/040464

PCT Pub. Date: May 6, 2005

(65) Prior Publication Data

US 2007/0067962 A1 Mar. 29, 2007

(30) Foreign Application Priority Data

Oct. 21, 2003 (EP) ..... 03024208

(51) Int. Cl.
*D01G 19/10* (2006.01)

(52) U.S. Cl. ..... 19/115 R

(58) Field of Classification Search ..... 19/115 R, 19/215, 221

See application file for complete search history.

(56) References Cited

U.S. PATENT DOCUMENTS

| | | | | |
|---|---|---|---|---|
| 3,665,937 | A | 5/1972 | Nakagawa et al. | |
| 5,123,529 | A | 6/1992 | Hollingsworth | |
| 5,491,876 | A * | 2/1996 | Shofner et al. | 19/129 R |
| 5,560,085 | A * | 10/1996 | Egerer | 19/129 R |
| 5,822,972 | A * | 10/1998 | Patelke et al. | 57/408 |
| 6,675,444 | B2 * | 1/2004 | Gruber | 19/215 |

FOREIGN PATENT DOCUMENTS

| | | |
|---|---|---|
| DE | 1995126 | 10/1968 |
| EP | 0 382 899 | 8/1990 |
| EP | 1 254 976 A1 | 11/2002 |
| EP | 1 333 113 A1 | 8/2003 |

* cited by examiner

*Primary Examiner*—Shaun R Hurley
(74) *Attorney, Agent, or Firm*—Browdy and Neimark

(57) ABSTRACT

With a set, in particular for fixed combs or round combs on textile combing machines, comprising a plurality of needles which are arranged adjacent to each other, whereby each needle comprises a foot section and a tip section, and whereby between the tip sections of adjacent needles, a free opening area is formed, in which the fibres to be combed can penetrate during combing, it is provided that the needles are produced by punching, that at least the front end of the tip section is angular or previously bent, and that the needle density is >=33 needles per cm.

6 Claims, 2 Drawing Sheets

SET, COMPRISING A PLURALITY OF NEEDLES HAVING AN ANGULAR FRONT TIP

FIELD

The invention relates to a set, in particular for top or round combs on textile combing machines, comprising a plurality of needles which are arranged adjacent to each other, whereby each needle comprises a foot section and a tip section, and whereby between the tip sections of adjacent needles, a free opening area is formed, in which the fibres to be combed can penetrate during combing.

BACKGROUND

Sets of this type are used to a large extent in the textile industry. The quality of the set is a key factor in determining the quality of the final product. Here it is important that the set enables a high combing standard on the one hand, i.e. a high throughput, while on the other, ensuring that any impurities in fibre bands made of cotton or wool are reliably removed, and that the fibres are cleanly parallelised.

It is known that needles for sets of this type may be produced on the basis of a wire, which is formed using stamping, whereby a considerable level of deformation work is involved. On the other hand, it is also known that needles are produced on the basis of a metal sheet using punching, whereby the deformation work is reduced.

Standard sets for textile applications usually comprise a needle density of 23, 25 or 28 needles per cm. In individual cases, needle densities of 30 to 32 needles per cm have already been used for combing very fine wool at low machine running speeds. However, sets of this type are only used for the application described in exceptional cases.

SUMMARY

Based on this knowledge, the object of the invention is to further develop a set of the type described in the introduction in such a manner that an even better combing result is achieved to a higher combing standard.

This object is attained by the following means:

the needles are produced by punching, at least the front end of the tip section is angular or bent, and the needle density is >=33 needles per cm.

This combination of features according to the invention achieves a significantly improved combing result without increasing the level of combing, and with an unchanged machine run time in relation to the prior art. In particular, impurities with a small diameter are reliably combed out, and a higher, finer degree of parallelisation is achieved.

The needle density can preferably be 35 needles per cm.

The needle depth is advantageously larger than 1.1 mm, preferably 1.3 mm, and in particular approx. 1.5 mm.

The needle thickness can be preferably 0.28 mm, based on a metal sheet with a corresponding thickness.

BRIEF DESCRIPTION OF THE DRAWINGS

The invention will now be explained by way of a preferred exemplary embodiment with reference to the drawings, in which.

DETAILED DESCRIPTION

Figure 1:
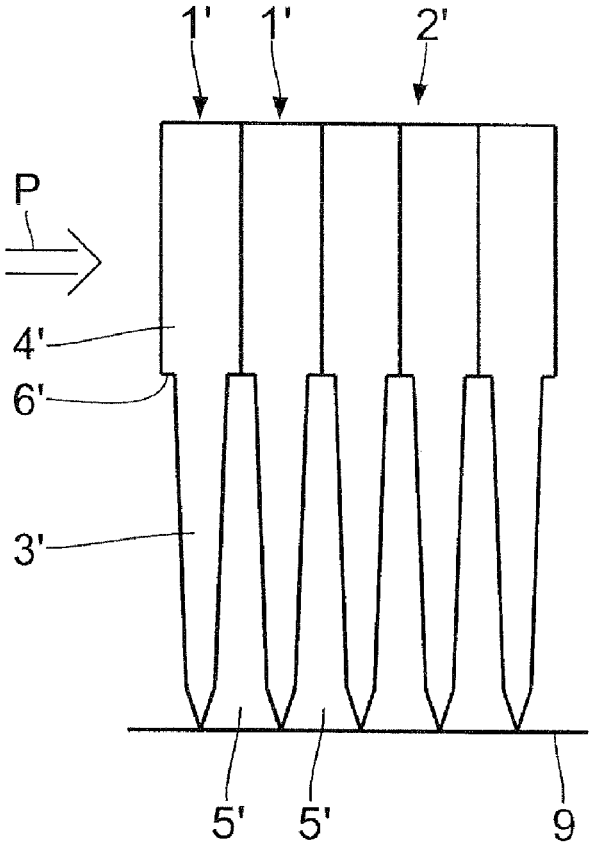
Fig. 1 (PRIOR ART)
FIG. 1 shows a set for a textile combining machine, viewed from the direction of engagement or stress according to the prior art.

The set shown in the drawing according to the prior art comprises a plurality of needles 1', which are arranged in a row adjacent to each other in the direction of the arrow P in FIG. 1 to form a row of needles 2'.

Each needle 1' comprises a tip section 3' and a foot section 4', whereby free opening areas 5' are formed between the tip sections 3'. A gradation 6' is formed on the transfer between the tip section 3' and the foot section 4', which leads to an increase in size in the free opening area 5', and which functions as a type of spacer between the tip sections 3'.

Figure 2:
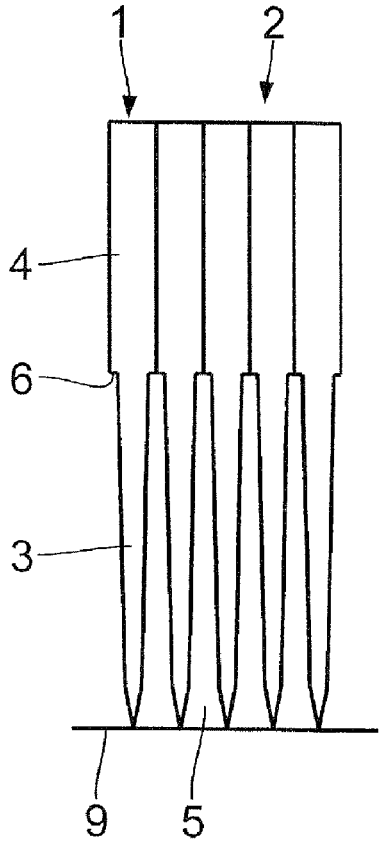
FIG. 2 shows a view which corresponds to FIG. 1 of a set according to the invention.
Figure 3:
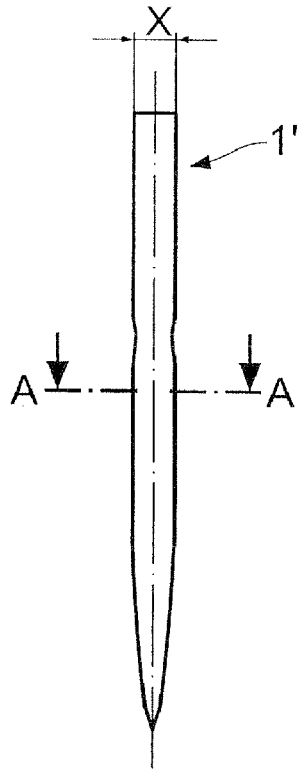
Fig. 3 (PRIOR ART)
FIG. 3 shows a view which is displaced by 90° in relation to the view in FIG. 1.
Figure 4:
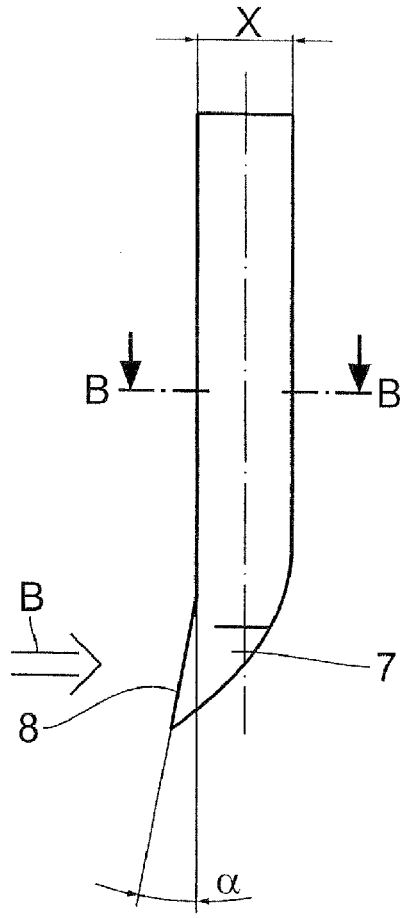
FIG. 4 shows a side view which is displaced by 90° in relation to the view in FIG. 1.
Figure 5:
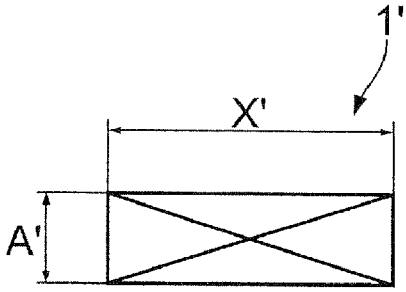
Fig. 5 (PRIOR ART)
FIG. 5 shows a cross-section along the line A-A in FIG. 3.
Figure 6:
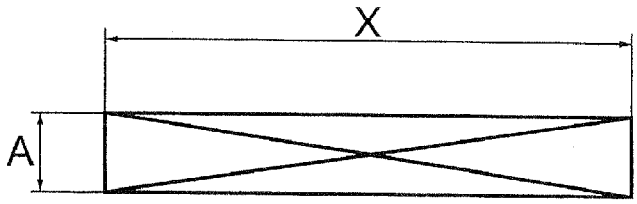
FIG. 6 shows a cross-section along the line B-B in FIG. 4.

FIG. 2 shows a row of needles 2 according to the invention with a plurality of needles 1, which in principle have a similar structure as the needles 1' according to the prior art, i.e. they comprise a tip section 3 which transfers via a gradation 6 to a foot section 4, whereby between the tip sections 3 of adjacent needles, free openings 5 have been left.

When both embodiments are viewed together, it is apparent that the needle density according to the invention is higher, i.e. with a preferred exemplary embodiment, it is 35 needles per cm, while in contrast, it is generally e.g. 23 needles per cm according to the prior art.

According to the invention, the width of the needles A is smaller than that according to the prior art (A'). This is achieved by punching the needles from a thinner metal sheet, e.g. with a thickness of 0.28 mm. In order to achieve adequate mechanical stability, the depth X of the needles 1 according to the invention is greater than the depth X' of the needles 1' according to the prior art, in other words, 1.5 mm, for example, instead of the standard 1.03 mm.

The tips 7 of the needles 1 according to the invention comprise a flank 8 which protrudes in the direction of stress (arrow B) or in the direction or engagement relative to the fibre band to be combed at an angle $\alpha$. Needles of this type with a protruding linear or sickle-shaped impact flank are already known for combing cotton, e.g. from DE 19 95 126 A1.

In connection with the increased needle density provided according to the invention, it is ensured in this manner that the fibres to be combed enter the free opening area 5, and are also effectively combed through without swimming to the surface 9 formed by the tips 7.

Despite the increased needle density provided according to the invention, the surface of the free needle opening 5 is higher according to the invention than according to the prior art.

With a standard set with 23 needles per cm, the free opening is 1.66 $mm^2$ per needle and 28 $mm^2$ per cm; by contrast, with the 35 needles per cm provided according to the invention, for example, the free opening per needle is 1.15 $mm^2$ and 40.18 $mm^2$ per cm.

An embodiment described here is suitable in particular and surprisingly not only for combing cotton, but also for combing wool.

With the given comparison between the opening or cleaning parameter per needle, it is clear that according to the invention, the cleaning effect is increased from D=1.66 according to the prior art to D=1.15, in other words, by 44%, for example, whereby at the same time, an increase in the opening area overall is achieved, i.e. the machine capacity can be maintained or even increased, whereby when the machine capacity remains the same, the fibres are processed more gently as a result of the increase in opening area from 38 $mm^2$ per cm to 40.25 $mm^2$ per cm, i.e. by 6%.

An improvement in the cleaning quality is achieved since the fibres are distributed more evenly due to the lesser distance, since the fibre density between the adjacent needles is reduced due to the increase in needle density, and finally, since a reduction in impurities of 44% is recorded in contrasts to a standard density of 23 needles per cm.

The invention claimed is:

1. A top comb configured to be used on textile combing machines, comprising:

a plurality of needles which are arranged adjacent to each other, each needle comprising a foot section and a tip section, and a free opening area formed between the tip sections of adjacent needles, in which the fibres to be combed can penetrate during combing, wherein the needles are produced by punching, at least the front end of the tip section is angular or bent forward, and the needle density is >=33 needles per cm.

2. A set according to claim 1, wherein the needle density is 35 needles per cm.

3. A set according to claim 1, wherein the needle depth is greater than 1.1 mm.

4. A set according to claim 1, wherein the needle thickness is approximately 0.28 mm.

5. A set according to claim 1, wherein the needle depth is greater than 1.3 mm.

6. A set according to claim 1, wherein the needle depth is approximately 1.5 mm.

* * * * *